US011603172B1

(12) United States Patent
Duffy-Protentis

(10) Patent No.: US 11,603,172 B1
(45) Date of Patent: Mar. 14, 2023

(54) METHOD AND APPARATUS FOR USING ELECTRIC WATERCRAFT HAVING A WARNING LIGHT

(71) Applicant: JaccPro, LLC, Easton, MA (US)

(72) Inventor: Jack Patrick Duffy-Protentis, Worcester, MA (US)

(73) Assignee: Jack Patrick Duffy-Protentis, Worcester, MA (US)

( * ) Notice: Subject to any disclaimer, the term of this patent is extended or adjusted under 35 U.S.C. 154(b) by 0 days.

(21) Appl. No.: 17/900,004

(22) Filed: Aug. 31, 2022

(51) Int. Cl.
*B63B 34/10* (2020.01)
*B63B 45/04* (2006.01)
*B63H 21/17* (2006.01)

(52) U.S. Cl.
CPC ..... *B63B 34/10* (2020.02); *B63B 45/04* (2013.01); *B63H 21/17* (2013.01)

(58) Field of Classification Search
CPC ..... B63B 34/10; B63B 45/04; B63H 21/17
See application file for complete search history.

(56) References Cited

U.S. PATENT DOCUMENTS

2004/0242088 A1* 12/2004 McCann ..... B63H 11/08 440/6
2007/0049137 A1* 3/2007 Lemchen ..... B63B 45/04 440/2
2007/0283864 A1* 12/2007 Hattori ..... B63B 34/10 114/55.57
2021/0371064 A1* 12/2021 Boks ..... B63B 79/10

* cited by examiner

*Primary Examiner* — Stephen P Avila
(74) *Attorney, Agent, or Firm* — Caldwell Intellectual Property Law

(57) ABSTRACT

In an aspect the present disclosure is directed to an electric watercraft having a warning light, wherein the electric watercraft includes at least an electric propulsor configured to propel the electric watercraft in a fluid. Electric watercraft further include a plurality of battery packs located beneath a deck of the electric watercraft and configured to poser the at least an electric propulsor. Electric watercraft further include a warning light located on at aft facing surface of the electric watercraft and configured to be viewable from behind the electric watercraft. The electric watercraft further includes at least a controller located on the electric watercraft and in communication with the at least a warning light, wherein the controller is configured to receive at least a warning signal and illuminate the at least a warning light as a function of the at least a warning signal.

16 Claims, 5 Drawing Sheets

METHOD AND APPARATUS FOR USING ELECTRIC WATERCRAFT HAVING A WARNING LIGHT

FIELD OF THE INVENTION

The present invention generally relates to the field of electric watercraft. In particular, the present invention is directed to method and apparatus for using electric watercraft having a warning light.

BACKGROUND

Personal watercraft (PWC) such as jet-propelled personal watercraft often are used in groups. Additionally, most personal watercraft are powered by gasoline and diesel which emits toxic chemicals into the atmosphere.

SUMMARY OF THE DISCLOSURE

In an aspect, the present disclosure is directed to an electric watercraft having a warning light, wherein the electric watercraft includes at least an electric propulsor configured to propel the electric watercraft in a fluid. Electric watercraft further include a plurality of battery packs located beneath a deck of the electric watercraft and configured to power the at least an electric propulsor. Electric watercraft further include a warning light located on an aft facing surface of the electric watercraft and configured to be viewable from behind the electric watercraft. The electric watercraft further includes at least a controller located on the electric watercraft and in communication with the at least a warning light, wherein the controller is configured to receive at least a warning signal and illuminate the at least a warning light as a function of the at least a warning signal.

In another aspect, a method for using an electric watercraft having a warning light is shown, the method includes propelling, using an electric propulsor, the electric watercraft in a fluid. The method further includes powering, using a battery pack located beneath a deck of the electric watercraft, the electric propulsor. The method further includes receiving, using a controller, a warning signal, wherein the at least a controller is located on the electric watercraft and in communication with at least a warning light. The method further includes illuminating, using the controller, a warning light as a function of the warning signal, wherein the warning light is located on at an aft facing surface of the electric watercraft and configured to be viewable from behind the electric watercraft.

These and other aspects and features of non-limiting embodiments of the present invention will become apparent to those skilled in the art upon review of the following description of specific non-limiting embodiments of the invention in conjunction with the accompanying drawings.

For the purpose of illustrating the invention, the drawings show aspects of one or more embodiments of the invention. However, it should be understood that the present invention is not limited to the precise arrangements and instrumentalities shown in the drawings, wherein:

FIG. 1 is a diagram of an exemplary embodiment of an electric watercraft having a warning light;

FIG. 2 is a block diagram of an exemplary embodiment of a warning light circuit;

FIG. 3 is an illustration of an exploded view of an electric motor in the electric watercraft;

FIG. 4 is flow diagram of an exemplary method of using an exemplary electric watercraft having a warning light; and FIG. 5 is a block diagram of a computing system that can be used to implement any one or more of the methodologies disclosed herein and any one or more portions thereof.

The drawings are not necessarily to scale and may be illustrated by phantom lines, diagrammatic representations and fragmentary views. In certain instances, details that are not necessary for an understanding of the embodiments or that render other details difficult to perceive may have been omitted.

BRIEF DESCRIPTION OF THE DRAWINGS

At high level, aspects of the present disclosure are directed to electric watercraft having a warning light and method for using electric watercraft having a warning light. An electric watercraft having a warning light may include at least a warning light located on an aft surface of the electric watercraft and configured to be viewable from behind the electric watercraft. Electric watercraft may further include at least a controller located on the electric watercraft and in communication with at least a warning light, wherein the controller may be configured to receive at least a warning signal and illuminate the at least a warning light as a function of the at least a warning signal.

Now referring to FIG. 1, an exemplary embodiment of an electric watercraft 100 having a warning light is illustrated. An "electric watercraft," as used in this disclosure, is a vehicle used in or on water that is powered by electricity. The electric watercraft 100 may include any marine vehicle. For example, electric watercraft may include boats, hovercraft, personal watercraft (PWC), unmanned watercraft, submarines, and the like. The electric watercraft 100 may be a sit-down watercraft. As used in this disclosure, a "sit-down watercraft" is a watercraft where the rider of the watercraft uses the watercraft mainly sitting down. The electric watercraft 100 may also be a stand-up watercraft. As used in this disclosure, a "stand-up watercraft" is a watercraft where the rider of the watercraft uses the watercraft standing up. The electric watercraft 100 may include a hull 104, wherein a plurality of parts resides in or on the hull. In an embodiment, the electric watercraft 100 may include at least a passenger seat 108 located on a deck. Deck may be a covering that sits on top of hull. In some cases, watercraft may include a plurality of passenger seats. In some cases, each passenger seat of a plurality of passenger seats 108 may be designed to fit one passenger. In another embodiment, electric watercraft 100 may not include any passenger seat 108 on the deck. In a non-limiting example, electric watercraft 100 may be an electrically powered jet-propelled personal watercraft with two passenger seats 108.

Figure 1:
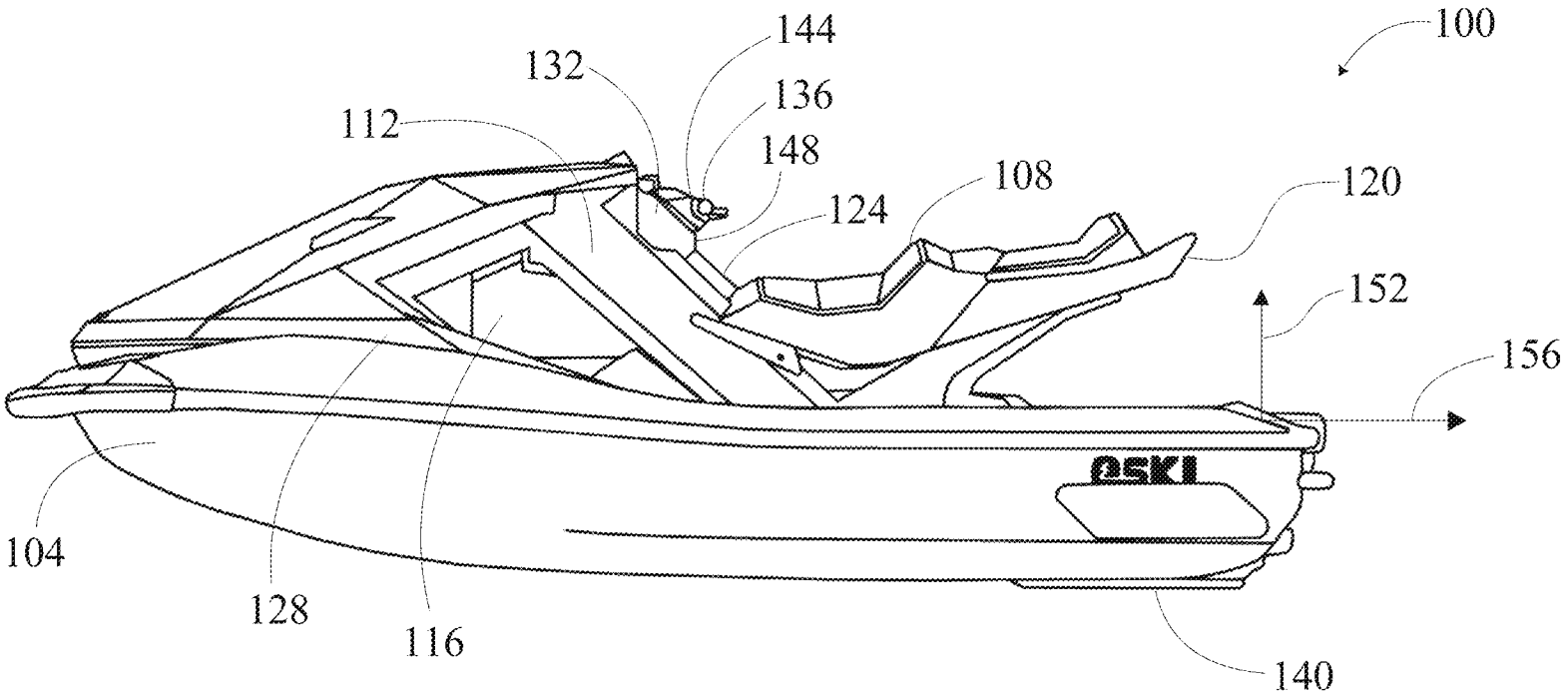

With continued reference to FIG. 1, electric watercraft may be powered by a plurality of battery packs 112. A "battery pack," as used in this disclosure, is a set of a plurality of battery cells. In some cases, plurality of battery packs 112 may be configured in series, parallel, or a mixture of both to deliver certain voltage, capacity, and/or power density. Each battery pack of plurality of battery packs 112 may contain at least an electric conductor. In some cases, plurality of battery packs 112 may include a plurality of electric conductors. Each electric conductor may provide electrical conductivity between one or more batteries or battery cells within battery pack. An "electric conductor," as used in this disclosure, is an object or type of material that conducts a flow of charge or electric current. Exemplary battery cells in battery pack 112 may include, lithium-ion battery cells, lithium-metal battery cells, air-metal battery cells, lead-acid battery cells, or the like. In some embodiment, battery pack 112 may include a battery regulator. As described in this disclosure, a "battery regulator" is an electric device in a battery pack that performs battery regulation or redistribution. As used in this disclosure, "battery regulation" or "battery redistribution" refers to a process that keep voltage of each individual cell below its maximum value during operation, non-operation, or charging. In some embodiment, battery pack 112 may include a battery balancer. As described herein, a "battery balancer" is an electric device in the battery pack that performs battery balancing. As used in this disclosure, "battery balancing" refers to a process that balances electric energy from one or more first battery cells (e.g., strong battery cells) to one or more second battery cells (e.g., weaker battery cells). Battery pack 112 may be an inline package, wherein a plurality of battery cells is selected and stacked with solder in between them.

With continued reference to FIG. 1, in an embodiment, battery pack 112 may be an absorbent glass mat (AGM) battery. As used in this disclosure, an "absorbent glass mat battery" is a type of a valve regulated lead-acid (VRLA) battery. In some cases, valve regulated lead-acid battery may limit amount of electrolyte absorbed in a plate separator, wherein the plate separator may include a positive plate and a negative plate which facilitate oxygen recombination within battery cell. In an embodiment, valve regulated lead-acid battery may further form absorbed electrolyte into a gel. In another embodiment, valve regulated lead-acid battery may include a relief valve, wherein the relief valve may retain plurality of components within valve regulated lead-acid battery in independent positions. In some embodiments, absorbent glass mat battery may include a fiberglass mesh, wherein the fiberglass mesh may be placed between positive plate and negative plate. In some cases, fiberglass mesh may include electrolyte and separate positive plate and negative plate. Further, Positive plate and/or negative plate may be in any shape such as, without limitation, flat, bent, rolled, and the like thereof. In some embodiments, absorbent glass mat battery may be mounted in any orientation. Additionally, or alternatively, absorbent glass mat battery may be maintenance-free. As used in this disclosure, "maintenance-free" means no constant maintenance required, but cleaning and/or regular function testing is still required. In other embodiments, absorbent glass mat battery may resist self-discharging within a wide range of temperatures.

With continued reference to FIG. 1, electric watercraft may include a propulsive capability. Propulsive capability may include, but is not limited to propelled by sail, oar, paddle, or motor. In an embodiment, electric watercraft may include an electric motor 116. An "electric motor," as used in this disclosure, is any machine that converts electrical energy into mechanical energy (i.e., work). Electric motor 116 may be driven by direct current (DC) or alternating current (AC) electric power and may include, without limitation, brushless DC electric motors, switched reluctance motors, induction motors, or any combination thereof. Electric motor 116 may also include electronic speed controllers or other components for regulating motor speed, rotation direction, and/or dynamic braking. A "motor" as used in this disclosure is any machine that converts non-mechanical energy into mechanical energy.

With continued reference to FIG. 1, electric watercraft includes at least a warning light 120. In some cases, at least a warning light 120 may be located on an aft surface of electric watercraft. Alternatively or additionally, at least a warning light may be located on an aft facing surface of electric watercraft. At least a warning light 120 may be configured to be viewable from behind electric watercraft. In an embodiment, warning light 120 may be configured to be mechanically affixed to a rear face of electric watercraft. Rear face of electric watercraft 100 may be located below or incorporated into a rear passenger seat 108 of the electric watercraft 100. A "warning light," as used in this disclosure, is an auxiliary lighting element that indicates any aspect of an electric watercraft's operation, function, malfunction, or emergency. Electric watercraft operation may include, but is not limited to, charging, power on, power off, stationary, steering left, steering right, forward, backward, acceleration, deceleration, and the like. Electric watercraft malfunction may include, but is not limited to, battery malfunction, motor malfunction, throttle malfunction, steering control malfunction, hull failure, and the like. Electric watercraft emergency may include, but is not limited to, roll over, driver/passenger fall off, collision, stranded, and the like. A "lighting element," as used in this disclosure, is an element that produce visible light, for example from electric power. In an embodiment, warning light 120 may be attached to one or more battery packs of plurality of battery packs 112. Warning light 120 may include a plurality of lighting elements. In a non-limiting example, warning light 120 may include a plurality of light-emitting diode (LED) lighting elements. In some embodiments, warning light 120 may be located within a housing embedded within a rear face of electric watercraft.

With continued reference to FIG. 1, electric watercraft 100 may include a controller 124. Controller 124 may include any computing device as described in this disclosure, including without limitation a microcontroller, microprocessor, digital signal processor (DSP) and/or system on a chip (SoC) as described in this disclosure. Computing device may include, be included in, and/or communicate with a mobile device such as a mobile telephone or smartphone. Controller 124 may include a single computing device operating independently, or may include two or more computing device operating in concert, in parallel, sequentially or the like; two or more computing devices may be included together in a single computing device or in two or more computing devices. Controller 124 may interface or communicate with one or more additional devices as described below in further detail via a network interface device. Network interface device may be utilized for connecting controller 124 to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. Controller 124 may include but is not limited to, for example, a computing device or cluster of computing devices in a first location and a second computing device or cluster of computing devices in a second location. Controller 124 may include one or more computing devices dedicated to data storage, security, distribution of traffic for load balancing, and the like. Controller 124 may distribute one or more computing tasks as described below across a plurality of computing devices of computing device, which may operate in parallel, in series, redundantly, or in any other manner used for distribution of tasks or memory between computing devices. Controller 124 may be implemented using a "shared nothing" architecture in which data is cached at the worker, in an embodiment, this may enable scalability of the electric watercraft 100 and/or computing device.

With continued reference to FIG. 1, controller 124 may be designed and/or configured to perform any method, method step, or sequence of method steps in any embodiment described in this disclosure, in any order and with any degree of repetition. For instance, Controller 124 may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Controller 124 may perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

With continued reference to FIG. 1, controller 124 on electric watercraft 100 may be configured to receive at least a warning signal. Controller 124 may include at least a signal receiver. A "signal receiver," as used in this disclosure, is an electronic component that listens to, and receives a first signal from other electronic components, wherein a signal may include one or more digital and/or analog signals. In an embodiment, first signal may be an earning signal. Controller 124 may be further configured to, without limitation, perform preprocessing, lexical analysis, parsing, semantic analysis of first signal, and the like.

With continued reference to FIG. 1, controller 124 on electric watercraft 100 may be further configured to illuminate at least a warning light 120 as a function of at least a warning signal. "Illuminating," as used in this disclosure, is making at least a lighting element visible or bright. The controller 124 may include at least a signal transmitter. A "signal transmitter," as used in this disclosure, is a component that transmits/sends a signal to other components. In some cases, a signal transmitted may additionally transform a signal, for example a first signal into a second signal. In an embodiment, signal transmitter may transform a warning signal (first signal) into a lighting signal (second signal) and transmit the lighting signal to the warning light 120. The warning light 120 may be illuminated upon receiving the lighting signal from controller 124. In some embodiments, warning light 120 may also be extinguished upon receiving lighting signal from the controller 124.

With continued reference to FIG. 1, controller 124 on electric watercraft 100 may be further configured to receive a user input from a user and generate at least a warning signal as a function of the user input. As used in this disclosure, a "user input" is at least a datum and/or instruction entered by a user. In some cases, user input may be entered to or otherwise communicated with controller 124. User input may include, but is not limited to, throttle settings, steering control settings, warning light settings, battery settings and the like. In an embodiment, user input may include instructions to turn on warning light. In some cases, instructions to turn on warning light may generate a first warning signal. In some cases, first warning signal may be further transformed into a first lighting signal by signal transmitter in controller 124 and sent to the warning light 120. Warning light 120 may then be illuminated upon receiving first lighting signal. User input may also include instructions to turn off warning light. In some cases, instructions to turn off warning light may generate a second warning signal, and the second warning signal may be further transformed into a second lighting signal by signal transmitter in controller 124 and sent to the warning light 120. Warning light may then be extinguished upon receiving second lighting signal. In some embodiments, user input may include adjusting the brightness of warning light 120. Brightness of warning light may be represented in a range of numeric values, and/or percentage values. For example, brightness of the warning light may be within 0~100 or 0%~100%. Brightness of warning light may also be represented in categorical values, such as low, medium, high, and the like. In some embodiments, user input may include a selection of a lighting color of warning light 120 from a plurality of lighting colors of warning light 120. In some cases, plurality of lighting colors may include, but is not limited to red, yellow, orange, blue, green, and the like. Additionally, user input may include a selection of a flash pattern of the warning light 120 from the plurality of flash patterns. A "flash pattern," as used in this disclosure, is the type of strobing, flashing, or lighting effect. In a non-limited example, warning light 120 may be illuminated continuously. In another example, warning light 120 may be illuminated in a flash pattern and/or predefined loop.

With continued reference to FIG. 1, electric watercraft 100 may further include at least a sensor 128. Sensor 128 may be attached to at least a battery pack of plurality battery packs 112. In an embodiment, sensor 128 may be remote to plurality of battery packs 112. Sensor may be communicatively connected to controller 124 or any other computing device disclosed in this disclosure. Sensor 128 may include one or more sensors. For instance, and without limitation, sensor 128 may include a plurality of sensors. In one or more embodiments, and without limitation, sensor 128 may include one or more of temperature sensor, voltmeter, current sensor, hydrometer, infrared sensor, photoelectric sensor, ionization smoke sensor, motion sensor, pressure sensor, radiation sensor, level sensor, imaging device, moisture sensor, gas and chemical sensor, flame sensor, electrical sensor, imaging sensor, force sensor, Hall sensor, and the like. Sensor 128 may be a contact or a non-contact sensor. For example, and without limitation, sensor 128 may be connected to electric watercraft 100. In other embodiments, sensor 128 may be remote to the plurality of battery packs 112.

With continued reference to FIG. 1, in some cases, at least a sensor 128 of electric watercraft 100 may be further configured to detect at least a speed of electric watercraft 100 and generate at least a warning signal as a function of at least a speed. In an embodiment, at least a speed of the electric watercraft may be at least a speed reading from a speedometer of electric watercraft 100. As used in this disclosure, a "speedometer" is an instrument that measures a speed of electric watercraft 100. Speedometer may include water speed indicators, air speed indicators, global position system-based speed indicators, and inertial measurement units (IMUS). In a non-limited example, at least a sensor 128 may detect a first speed from speedometer of the electric watercraft 100. At least a sensor 128 may detect a second speed from speedometer of the electric watercraft 100. Sensor 128 may compare first speed with second speed and generate a warning signal as a function of the comparison. For instance, sensor 128 and/or controller may generate a warning signal when first speed is greater than second speed (i.e., deceleration of electric watercraft 100). In another example, sensor 128 and/or controller may generate a warning signal when first speed is less than second speed (i.e., acceleration of electric watercraft 100). In some cases, sensor 128 and/or controller may generate a warning signal when first speed and second speed are of different sign (e.g., electric watercraft 100 is placed in reverse). In some other cases, sensor 128 and/or controller may generate a warning signal when sensor 128 detect a non-zero proper acceleration from the inertial measurement unit of the speedometer of electric watercraft 100. As used in this disclosure, an "inertial measurement unit" is an electronic device that measures and reports a body's specific force, angular rate, body's orientation using a combination of accelerometers and gyroscopes.

With continued reference to FIG. 1, at least a sensor 128 of electric watercraft 100 may be further configured to detect a current steering angle of electric watercraft 100. As described herein, a "steering angle" is an angle commanded using a steering control 132. A "steering control," as used in this disclosure, is a component that enables an individual to control a travel direction of electric watercraft 100. The travel direction of electric watercraft 100 may include, but is not limited to, straight, right, left and the like. In some cases, steering control 132 may include a handlebar 136. In other cases, steering control 132 may include one or more nozzles 140. As used in this disclosure, a "nozzle" is a device used for directing the stream of water to certain direction located on the electric watercraft 100. One or more nozzles may be connected to the electric motor 116.

With continued reference to FIG. 1, in some embodiments, at least a sensor 128 of electric watercraft 100 may be further configured to calculate a steering angle threshold as a function of at least a speed of the electric watercraft 100. Sensor 128 and/or controller may generate at least a warning signal as a function of current steering angle and steering angle threshold. As used in current disclosure, a "steering angle threshold" is a degree of steering angle that must and/or must not be exceeded for further processing and action of the sensor 128 and/or the controller 124 to occur. In a non-limited example, at least a speed of electric watercraft 100 may be current speed of the electric watercraft 100. In some embodiments, a warning signal may be generated by sensor 128 and/or controller when current steering angle is greater than steering angle threshold, wherein the steering angle threshold is calculated using the controller 124 as a function of the current speed of the electric watercraft 100.

With continued reference to FIG. 1, in some embodiments, at least a sensor 128 of electric watercraft 100 may be further configured to detect at least a throttle datum. At least a throttle datum may include a twist position of a throttle control 144 located on electric watercraft. Sensor 128 and/or controller may be configured to generate at least a warning signal as a function of throttle datum. As used in this disclosure, a "throttle control" is an input that can be used by a user to control throttle of an electric watercraft 100. In an embodiment, throttle control 144 may be connected to a throttle of electric watercraft 100. As used in this disclosure, a "throttle" is a mechanism of a device which manage the flow of a fluid by constriction or obstruction. In some cases, throttle may control electric motor's power by regulating amount of fluid entering electric motor's impeller. In some embodiments, throttle control 144 may include a thumb throttle, wherein the thumb throttle may be available to driver at any time electric watercraft 100 is powered on. In some cases, thumb throttle maybe controlled by a thumb of driver. In other embodiments, throttle control 144 may include a finger throttle, wherein the finger throttle may be controlled with a finger of driver. In some cases, finger throttle may improve grip by allowing thumb of driver to grip throttle control 144. In an embodiment, throttle control 144 may be located on handlebar 136 of steering control 132 of electric watercraft 100 and rotated according to a rotation axis parallel to handlebar 136. Throttle control 144 may include a default twist position, wherein the default twist position may keep electric watercraft in a natural position (e.g., non-accelerating/non-decelerating). In a non-limited example, a warning signal may be generated by sensor 128 when twist position detected by sensor 128 differs from default twist position.

With continued reference to FIG. 1, in some embodiments, at least a sensor 128 of electric watercraft 100 may be further configured to detect at least a pressure. For instance, sensor 128 may include a pressure sensor, pressure, switch, pitot tube, strain gauge, or the like. In some cases, at least a sensor 128 may be configured to detect multiple pressures, for instance along different axis of electric watercraft 100. In some cases, at least a sensor 128 may detect a first pressure on a first axis 152, and a second pressure on a second axis 156. At least a sensor 128 and/or controller may generate at least a warning signal as a function of first pressure and second pressure. In a non-limited example, first axis may be an axis generally perpendicular to a water surface and/or normal to a top of electric watercraft 100, and second axis may be an axis parallel to a water surface and/or a longitudinal plane of the electric watercraft 100. In an embodiment, a warning signal may be generated by sensor 128 and/or controller when first pressure, second pressure, or both pressures indicate deceleration of electric watercraft. In another embodiment, a warning signal may be generated by sensor 128 when first pressure and/or second pressure (alone or aggregated) are greater than or less than a pressure threshold. In some cases, pressure threshold may be preset or set through user input.

With continued reference to FIG. 1, in some embodiments, electric watercraft 100 may further include at least a safety device 148. As used in this disclosure, a "safety device" is a device that is activated and/or deactivated if a human operator (e.g., driver/passenger) becomes incapacitated, such as loss of consciousness, physically removed from control, or falls off. In an embodiment, safety device 148 may be activated manually by driver and/or passengers. Safety device 148 may be located at front of the electric watercraft 100 and/or proximal user. Safety device 148 may be contained within a housing, wherein housing is designed to protect safety device from any incorrect manual activation. In some embodiments, safety device may be attached to one or more battery packs of the plurality of battery packs 112. In some embodiments, safety device 148 may be communicatively connected to controller 124. In some embodiments, safety device may be connected to sensor 128. Safety device 148 may further be configured to receive at least an activation signal and generate at least a warning signal as a function of the at least an activation signal. In some cases, activation signal may be generated from sensor 128 and/or manual activation. Manual activation of safety device 148 may include, but is not limited to, turn on a switch, press a button, pull a lever, or the like. In a non-limited example, safety device 148 may receive an activation signal upon a driver falling off (man overboard) electric watercraft 100. Man overboard may be detected by sensor 128, for instance with a dead-man switch, clasp or the like. Upon detection of man overboard safety device 148 and/or controller 128 may generate a warning signal, and the warning signal may be further transformed into a lighting signal and transmitted to warning light 120. Warning light 120 may then be illuminated upon receiving lighting signal.

Figure 2:
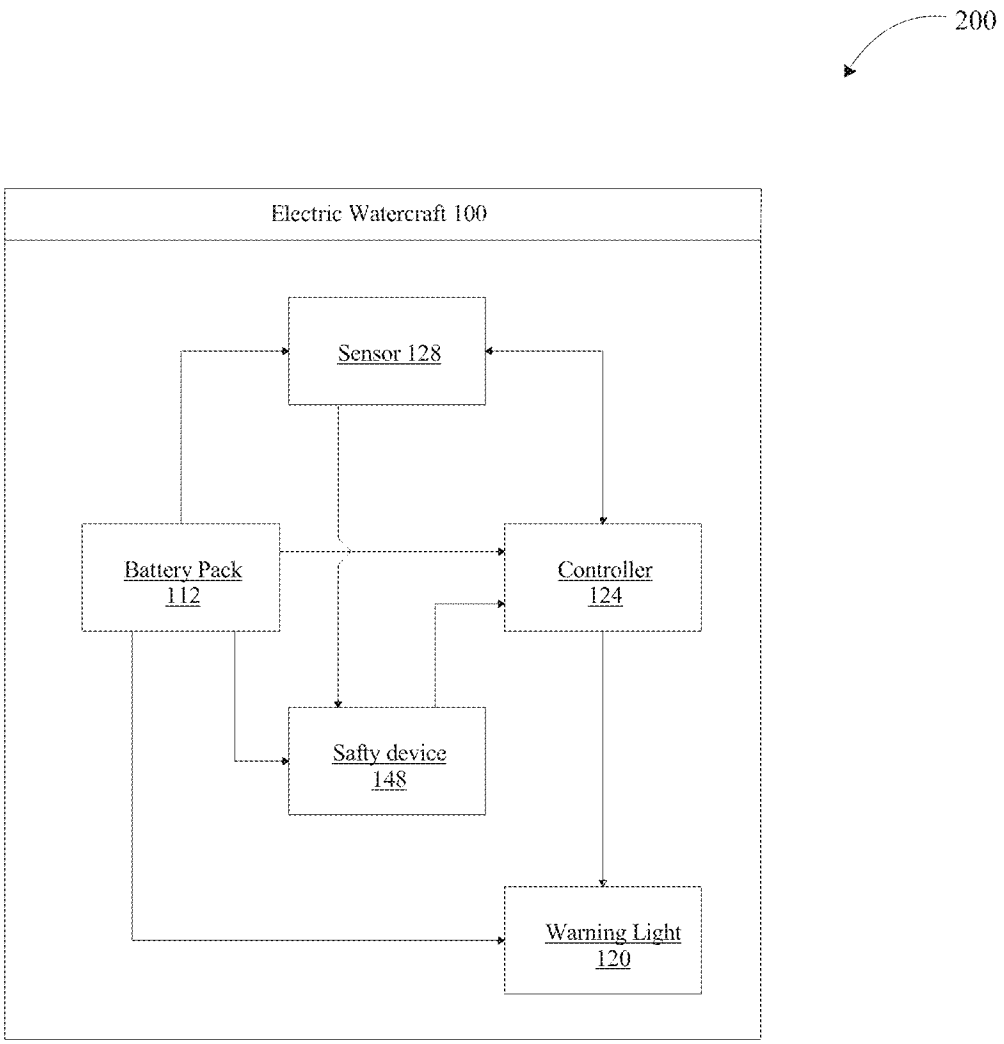

Referring now to FIG. 2, a block diagram of the warning light circuit 200 is illustrated. The warning light circuit 200 may include an electric watercraft 100. A "circuit," as used in this disclosure, is a connection of a plurality of electronic components with conductive wires/traces through which electric current can flow. Electronic components may include, but is not limited to, resistor, transistor, capacitor, inductor, and the like. In some embodiments, electric watercraft may include, without limitation, at least a battery pack 112, at least a sensor 128, at least a safety device 148, at least a controller 124, and at least a warning light 120. Battery pack 112 may provide electric power to electric watercraft 100 including without limitation, sensor 128, safety device 148, controller 124, and warning light 120. In some embodiments, warning light 120 may be connected to the controller 124. In some cases, controller 124 may send a warning signal to warning light 120, and the warning light 120 may be turned on upon receiving the warning signal from the controller 124.

With continued reference to FIG. 2, controller 124 may be in communication with sensor 128. In some embodiments, sensor 128 may generate and send a warning signal when exceeding steering angle threshold is detected, to controller 124. In other embodiments, sensor 128 may generate and send a warning signal when failing the throttle setting is detected, to controller 124. In some cases, communication of controller 124 and sensor 128 may be bidirectional. As used in this disclosure, a "bidirectional communication" is a communication mode capable of transmitting at least a datum and/or signal in both direction (send and receive). In a non-limited example, sensor 128 may receive a start signal from controller 124 to start sensing for speed of electric watercraft 100. Sensor 128 may then generate a warning signal when electric watercraft is decelerating and send the warning signal to controller 124.

With continued reference to FIG. 2, safety device 148 may be communicatively connected to controller 124. In some embodiment, safety device 148 may receive an activation signal and generate a warning signal as a function of the activation signal. In some cases, safety device 148 may send warning signal to controller 124. In other embodiments, safety device 148 may be communicatively connected to at least a sensor 128. In a non-limited example, sensor 128 may send activation signal when falling of passenger is detected, to safety device 148. In some cases, safety device 148 may generate a warning signal as a function of activation signal received from sensor 128 and send the warning signal to controller 124. In other cases, safety device 148 may receive activation signal from manual activation of safety device 148.

Figure 3:
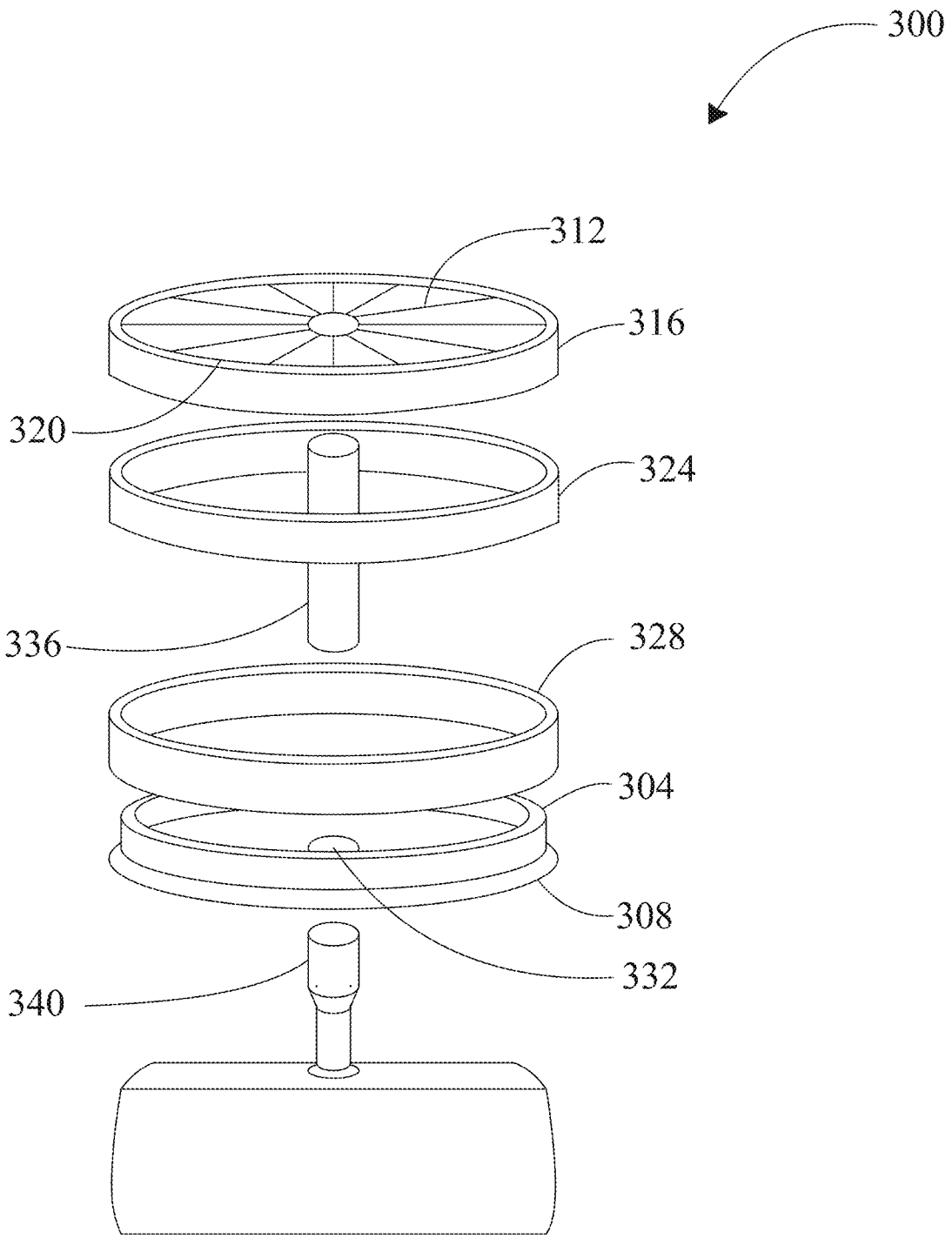

Referring now to FIG. 3, an embodiment of motor is illustrated. Electric motor 300 may include at least a stator 304. As used in this disclosure, a "stator" is a stationary component of a motor and/or motor assembly. In an embodiment, stator 304 may include at least first magnetic element 308. As used in this disclosure, a "first magnetic element" is an element that generates a magnetic field. For example, first magnetic element 308 may include one or more magnets which may be assembled in rows along a structural casing component. Further, first magnetic element 308 may include one or more magnets having magnetic poles oriented in at least a first direction. In some embodiments, magnets may include at least a permanent magnet. In some cases, permanent magnets may be composed of, but are not limited to, ceramic, alnico, samarium cobalt, neodymium iron boron materials, any rare earth magnets, and the like. In other embodiments, the magnets may include an electromagnet. As used in this disclosure, an "electromagnet" is an electrical component that generates magnetic field via induction. In some cases, electromagnet may include a coil of electrically conducting material, through which an electric current flow to generate the magnetic field, also called a field coil or field winding. In some cases, a coil may be wound around a magnetic core, which may include without limitation an iron core or other magnetic material. In some cases, core may include a plurality of steel rings insulated from one another and then laminated together. In an embodiment, plurality of steel rings may include slots in which the conducting wire will wrap around to form a coil. In some cases, first magnetic element 308 may act to produce or generate a magnetic field to cause other magnetic elements to rotate, as described in further detail below. In some embodiments, stator 304 may include a frame to house components including first magnetic element 308, as well as one or more other elements or components as described in further detail below. In other embodiments, magnetic field may be generated by first magnetic element 308 and can include a variable magnetic field. For example, variable magnetic field may be achieved by use of an inverter, a controller, or the like.

With continued reference to FIG. 3, electric motor 300 may include propulsor 312. In some embodiments, propulsor 312 may include an integrated rotor. As used in this disclosure, a "rotor" is a portion of an electric motor that rotates with respect to a stator of the electric motor, such as stator 304. As used in this disclosure, a "propulsor" is a component or device used to propel a vehicle by exerting force on a fluid medium, which may include a gaseous medium such as air or a liquid medium such as water. In some cases, propulsor 312 may be any device or component that consumes electrical power on demand to propel an aircraft or other vehicle while on ground, in fluid, and/or in flight. In other cases, propulsor 312 may include one or more propulsive devices. In an embodiment, propulsor 312 may include a thrust element which may be integrated into propulsor. In some cases, a thrust element may include any device or component that converts the mechanical energy of a motor, for instance in the form of rotational motion of a shaft, into thrust in a fluid medium. For example, thrust element may include without limitation a marine propeller or screw, an impeller, a turbine, a jet pump, a paddle or paddle-based device, or the like. In an embodiment, electric motor of electric watercraft may include a propulsor, wherein propulsor may include an impeller coupled with the rotor shaft. As used in this disclosure, an "impeller," is a rotor used to increase or decrease the pressure and flow of a fluid. In some cases, impeller may contain a cylinder with an open inlet to accept fluid. In some embodiments, impeller may include a plurality of metal blades around the center of the rotation (rotor shaft). In some cases, plurality of metal blades may push fluid radially. In other embodiments, impeller may also include a bore to accept a driver shaft, wherein the bore may be, but not limited to, splined, keyed, or threaded. In some cases, impeller may increase the pressure of the water. In other cases, impeller may also accelerate fluid outward from the center of rotation, transferring electric energy from electric motor that drives propulsor to fluid being output.

With continued reference to FIG. 3, in an embodiment, propulsor 312 may include a hub 316 rotatably mounted to stator 304. As used in this disclosure, "rotatably mounted," is functionally secured in a manner to allow rotation. As used in this disclosure, a "hub 316" is a structure which allows for the mechanically coupling of components of an integrated rotor assembly. In an embodiment, hub 316 may be mechanically coupled to propellers or blades. In an embodiment, hub 316 may be cylindrical in shape such that it may be mechanically joined to other components of rotor assembly. In some cases, hub 316 may be constructed of any suitable material or combination of materials, including without limitation metal such as aluminum, titanium, steel, or the like, polymer materials or composites, fiberglass, carbon fiber, wood, or any other suitable material. In other cases, hub 316 may move in a rotational manner driven by interaction between stator and components in rotor assembly. Persons skilled in the art, upon reviewing the entirety of this disclosure, will be aware of various structures that may be used as or included as hub 316, as used and described herein.

With continued reference to FIG. 3, in an embodiment, propulsor 312 and/or rotor shaft 336 may include second magnetic element 320, which may include one or more further magnetic elements. In some embodiment, second magnetic element 320 generates magnetic field designed to interact with first magnetic element 308. Further, second magnetic element 320 may be designed with a material such that magnetic poles of at least a second magnetic element are oriented in an opposite direction from first magnetic element 308. In other embodiments, second magnetic element 320 may be affixed to hub 316, rotor shaft 336, or another rotating or stationary electric motor component disclosed herein. As used in this disclosure, "Affixed," is the attachment, fastening, connection, and the like, of one component to another component. For example, and without limitation, affixed may include bonding second magnetic element 320 to hub 316, such as through hardware assembly, spot welding, riveting, brazing, soldering, glue, and the like. In some cases, second magnetic element 320 may include any magnetic element suitable for use as first magnetic element 308. For instance, and without limitation, second magnetic element may include a permanent magnet and/or an electromagnet. In other cases, second magnetic element 320 may include magnetic poles oriented in a second direction opposite, in whole or in part, of the orientation of poles of first magnetic element 308. In an embodiment, Electric motor 300 may include motor assembly incorporating stator 304 with first magnet element and second magnetic element 320. In some cases, first magnetic element 308 may include a plurality of magnetic poles oriented in a first direction, second magnetic element includes a plurality of magnetic poles oriented in an opposite direction than the plurality of magnetic poles in first magnetic element 308.

With continued reference to FIG. 3, in an embodiment, first magnetic element 308 may be a productive element. As used in this disclosure, a "productive element" is an element that produces a varying magnetic field. In some cases, productive elements may produce magnetic field that may attract and other magnetic elements, possibly including a receptive element. In some cases, second magnetic element may be productive or receptive element. A receptive element may react due to magnetic field of first magnetic element 308. In some embodiments, first magnetic element 308 may produce magnetic field according to magnetic poles of first magnetic element 308 oriented in first direction. Second magnetic element 320 may produce magnetic field with magnetic poles in opposite direction of first magnetic field, which may cause two magnetic elements to attract one another. Receptive magnetic element may be slightly larger in diameter than productive element. Interaction of productive and receptive magnetic elements may produce torque and cause the assembly to rotate. In some cases, hub 316 and rotor assembly may both be cylindrical in shape where rotor may have a slightly smaller circumference than hub 316 to allow the joining of both structures. In some embodiments, coupling of hub 316 to stator 304 may be accomplished via a surface modification of either hub 316, stator 304 or both to form a locking mechanism. In other embodiments, coupling may be accomplished using additional nuts, bolts, and/or other fastening apparatuses. In some cases, integrated rotor assembly as described above may reduce profile drag in forward traveling for electric watercraft. Profile drag may be caused by a number of external forces that the watercraft is subjected to. In an embodiment, incorporating propulsor 312 into hub 316, may reduce profile of Electric motor 300 resulting in a reduced profile drag. In some cases, rotor which may include motor inner magnet carrier 324, motor outer magnet carrier 328, propulsor 312 may be incorporated into hub 316. In an embodiment, inner motor magnet carrier 324 may rotate in response to magnetic field. The rotation may cause hub 316 to rotate. This unit may be inserted into Electric motor 300 as one unit. This may enable ease of installation, maintenance, and removal.

With continued reference to FIG. 3, stator 304 may include through-hole 332. In an embodiment, through-hole 332 may provide an opening for a component to be inserted through to aid in attaching propulsor with integrated rotor and rotor shaft to stator. In some cases, through-hole 332 may have a round or cylindrical shape and be located at a rotational axis of stator 304, which in an embodiment may be similar to or the same as axis of rotation 312. Hub 316 may be mounted to stator 304 by means of rotor shaft 336 rotatably inserted though through-hole 332. In some embodiments, rotor shaft 336 may be mechanically coupled to stator 304 such that rotor shaft 336 is free to rotate about its centerline axis, which may be effectively parallel and coincident to stator's centerline axis, and further rotor shaft and stator may include a void of empty space between them, where at least a portion the outer cylindrical surface of rotor shaft is not physically contacting at least a portion of inner cylindrical surface of stator. In some cases, this void may be filled, in whole or in part, by air, a vacuum, a partial vacuum or other gas or combination of gaseous elements and/or compounds, to name a few. In other embodiments, through-hole 332 may have a diameter that is slightly larger than a diameter of rotor shaft 336 to allow rotor shaft 336 to fit through through-hole 332 to connect stator 304 to hub 316. In some cases, rotor shaft 336 may rotate in response to rotation of propulsor 312.

With continued to FIG. 3, Electric motor 300 may include a bearing cartridge 340. In some cases, bearing cartridge 340 may include a bore. In an embodiment, rotor shaft 336 may be inserted through bore of bearing cartridge 340. In some cases, bearing cartridge 340 may be attached to a structural element of a vehicle. As used in this disclosure, "bearing cartridge" is a component functions to support the rotor and to transfer the loads from the motor. In some cases, loads may include, without limitation, weight, power, magnetic pull, pitch errors, out of balance situations, and the like. In some embodiments, bearing cartridge 340 may include bore. In other embodiments, bearing cartridge 340 may include a smooth metal ball or roller that rolls against a smooth inner and outer metal surface. The rollers or balls take the load, allowing the device to spin. In some cases, bearing cartridge may include, without limitation, ball bearing, straight roller bearing, tapered roller bearing or the like. In an embodiment, bearing cartridge 340 may be subject to load which may include, without limitation, radial or thrust load. Depending on the location of bearing cartridge 340 in the assembly, it may see all radial or thrust load or a combination of both. In some embodiments, bearing cartridge 340 may join electric motor 300 to a structure feature. In some cases, bearing cartridge 340 may function to minimize the structural impact from the transfer of bearing loads during traveling and/or to increase energy efficiency and power of propulsor. In other embodiments, bearing cartridge 340 may include a shaft and a collar arrangement, wherein the shaft affixed into the collar assembly. Further, bearing element may support the two joined structures by reducing transmission of vibration from such bearings. In some cases, roller (rolling-contact) bearings are conventionally used for locating and supporting machine parts such as rotors or rotating shafts. For example, rolling elements of roller bearing may be balls or rollers. In another example, roller bearing may be a type of anti-friction bearing. As used in this disclosure, a "roller bearing" is a type of bearing functions to reduce friction allowing free rotation. Additionally, roller bearing may act to transfer loads between rotating and stationary members. In an embodiment, bearing cartridge 340 may act to keep propulsor 312 and components intact during traveling by allowing Electric motor 300 to rotate freely while resisting loads such as an axial force. In an embodiment, bearing cartridge 340 may include roller bearing incorporated into the bore. In some cases, roller bearing may be in contact with rotor shaft 336. Stator 304 may be mechanically coupled to inverter housing. In some cases, mechanically coupled may include a mechanical fastening, without limitation, such as nuts, bolts, or other fastening device. In some embodiments, mechanically coupled may include welding or casting or the like. In other embodiments, inverter housing may contain bore which allows insertion by rotor shaft 336 into bearing cartridge 340.

With continued reference to FIG. 3, electric motor 300 may include motor assembly incorporating rotating assembly and a stationary assembly. In an embodiment, hub 316, motor inner magnet carrier 324 and rotor shaft 336 may be incorporated into rotor assembly of electric motor 300 which make up rotating parts of electric motor, moving between stator poles and transmitting motor power. As one integrated part, rotor assembly may be inserted and removed in one piece. In some embodiments, stator 304 may be incorporated into the stationary part of the motor assembly. In some cases, stator and rotor may combine to form an electric motor. In other embodiments, electric motor 300 may, for instance, incorporate coils of wire, which may be similar to or the same as any of the electrically conductive components in the entirety of this disclosure, which are driven by the magnetic force exerted by first magnetic field on an electric current. The function of motor may be to convert electrical energy into mechanical energy. In operation, a wire carrying current may create at least a first magnetic field with magnetic poles in a first orientation which interacts with a second magnetic field with magnetic poles oriented in an opposite direction of the first magnetic pole direction causing a force that may move rotor in a direction. For example, and without limitation, first magnetic element 308 in Electric motor 300 may include an active magnet. For instance, and without limitation, second magnetic element may include a passive magnet, the passive magnet that reacts to a magnetic force generated by first magnetic element 308. In an embodiment, first magnet positioned around the rotor assembly, may generate magnetic fields to affect the position of the rotor relative to stator 304. In some cases, controller may have an ability to adjust electricity originating from a power supply and, thereby, the magnetic forces generated, to ensure stable rotation of rotor, independent of the forces induced by the machinery process.

Figure 4:
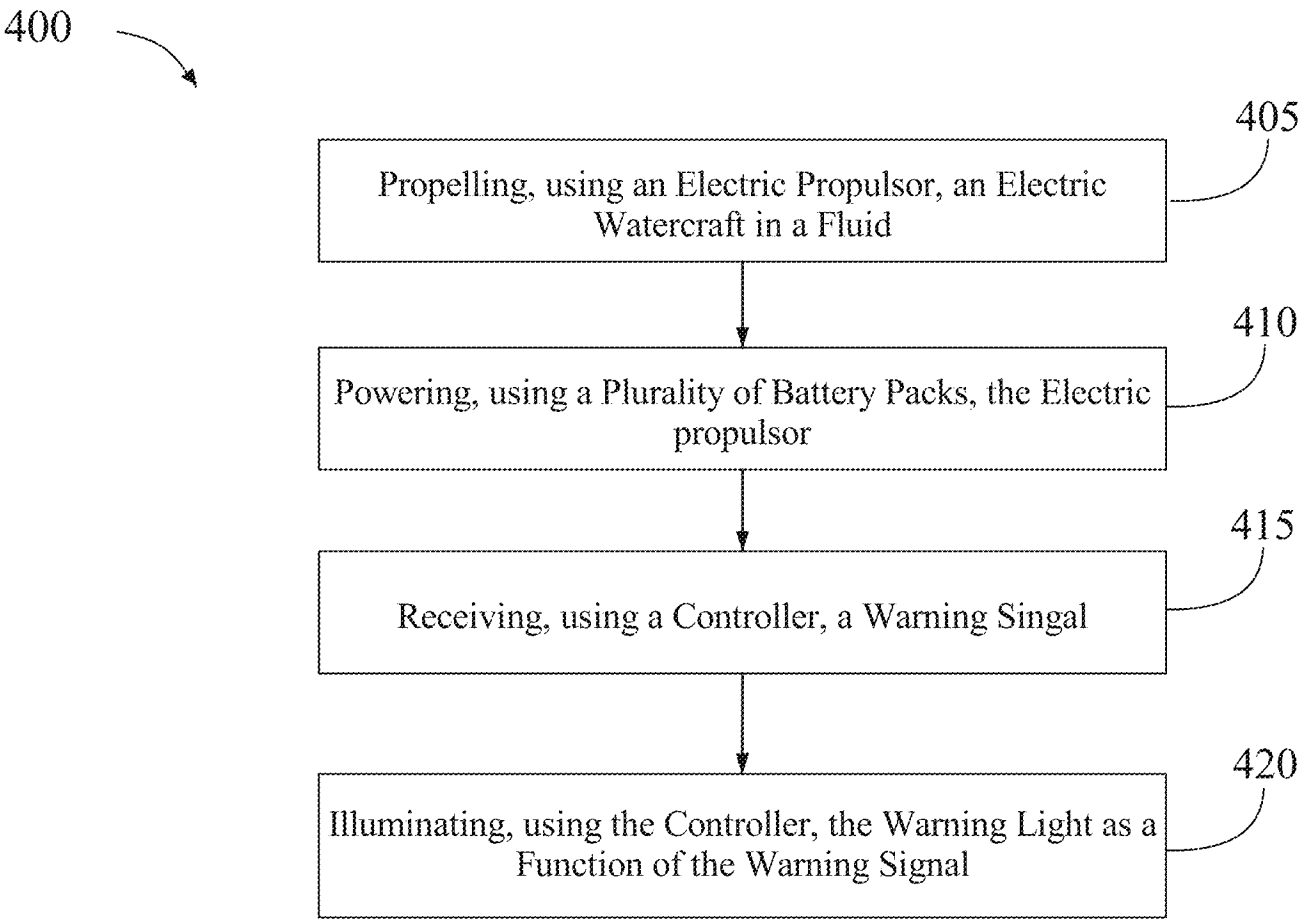

Referring now to FIG. 4, an exemplary method 400 for using an electric watercraft having a warning light is illustrated. Method 400 includes a step 405, of propelling, using at least an electric propulsor, electric watercraft in a fluid. This may be implemented, without limitation, as described above in reference to FIGS. 1-3. In an embodiment, electric watercraft may include an electrically powered jet-propelled personal watercraft. In some embodiments, electric watercraft may include an electric motor. This may be implemented, without limitation, as described above with reference to FIGS. 1-3.

With continued refence to FIG. 4, method 400 includes a step 410, of powering, using a plurality of battery packs located beneath a deck of electric watercraft, at least an electric propulsor. This may be implemented, without limitation, as described above with reference to FIGS. 1-3. In some embodiments, each battery pack of plurality of battery packs may include at least an electric conductor. In some cases, battery pack may include a battery regulator. In other cases, battery pack may include a battery balancer. This may be implemented, without limitation, as described above with reference to FIGS. 1-3.

With continued reference to FIG. 4, method 400 includes a step 415, of receiving, using a controller, wherein the controller is located on electric watercraft and in communication with warning light, a warning signal, without limitation, as described above in reference to FIGS. 1-3. In some embodiments, controller may further be configured to receive a user input from a user and generate at least a warning signal as a function of the user input, without limitation, as described above in reference to FIGS. 1-3. In some embodiments, electric watercraft may further include a sensor. This may be implemented without limitation, as described above with reference to FIGS. 1-3. In some embodiments, sensor may further be configured to detect a speed of the electric watercraft and generate a warning signal as a function of the speed of the electric watercraft, without limitation, as described above in reference to FIGS. 1-3. In some embodiments, sensor may further be configured to detect a current steering angle of the electric watercraft, calculate a steering angle threshold as a function of the speed of the electric watercraft, and generate warning signal as a function of the current steering angle and the steering angle threshold. This may be implemented, without limitation, as described above with reference to FIGS. 1-3. In some embodiments, sensor may be further configured to detect a first pressure on a first axis, a second pressure on a second axis, and generate warning signal as a function of the first pressure and the second pressure. This may be implemented, without limitation, as described above in reference to FIG. 1-3. In some embodiments, electric watercraft may further include a safety device, without limitation, as described above in reference to FIG. 1-3. In some embodiments, safety device may further be configured to receive an activation signal and generate at least a warning signal as a function of the activation signal, without limitation, as described above in reference to FIG. 1-3.

With continued reference to FIG. 4, method 400 includes a step 420 of illuminating, using controller, warning light as a function of at least a warning signal, wherein warning light is located on at an aft facing surface of electric watercraft and configured to be viewable from behind electric watercraft. This may be implemented, without limitation, as described above in reference to FIGS. 1-3. In some embodiments, warning light further include plurality of lighting patterns. In some embodiments, warning light further include plurality of colors. This may be implemented, without limitation, as described above in reference to FIGS. 1-3.

It is to be noted that any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random-access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 5:
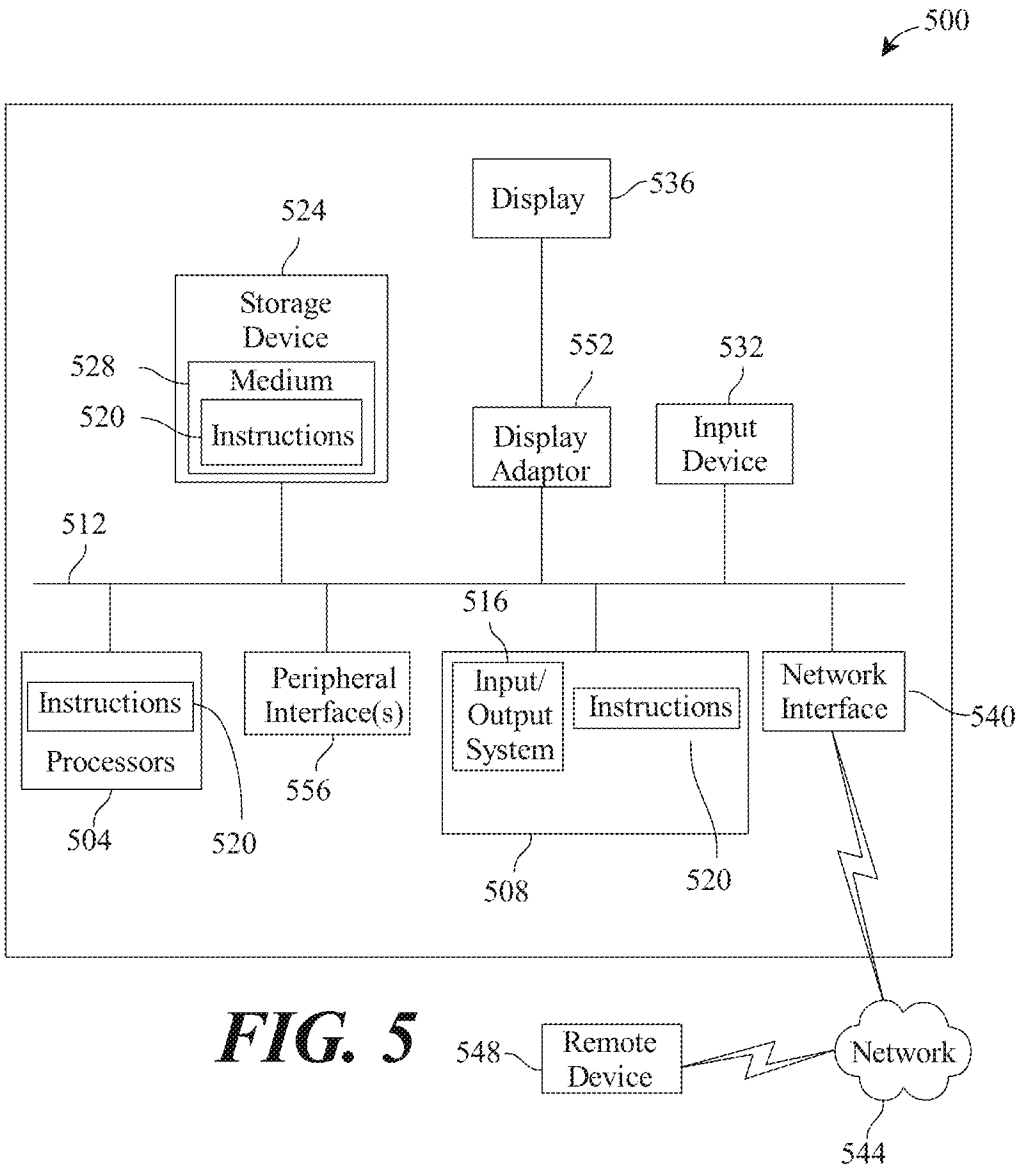

FIG. 5 shows a diagrammatic representation of one embodiment of a computing device in the exemplary form of a computer system 500 within which a set of instructions for causing a control system to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 500 includes a processor 504 and a memory 508 that communicate with each other, and with other components, via a bus 512. Bus 512 may include any of several types of bus structures including, but not limited to, a memory bus, a memory controller, a peripheral bus, a local bus, and any combinations thereof, using any of a variety of bus architectures.

Processor 504 may include any suitable processor, such as without limitation a processor incorporating logical circuitry for performing arithmetic and logical operations, such as an arithmetic and logic unit (ALU), which may be regulated with a state machine and directed by operational inputs from memory and/or sensors; processor 504 may be organized according to Von Neumann and/or Harvard architecture as a non-limiting example. Processor 504 may include, incorporate, and/or be incorporated in, without limitation, a microcontroller, microprocessor, digital signal processor (DSP), Field Programmable Gate Array (FPGA), Complex Programmable Logic Device (CPLD), Graphical Processing Unit (GPU), general purpose GPU, Tensor Processing Unit (TPU), analog or mixed signal processor, Trusted Platform Module (TPM), a floating-point unit (FPU), and/or system on a chip (SoC).

Memory 508 may include various components (e.g., machine-readable media) including, but not limited to, a random-access memory component, a read only component, and any combinations thereof. In one example, a basic input/output system 516 (BIOS), including basic routines that help to transfer information between elements within computer system 500, such as during start-up, may be stored in memory 508. Memory 508 may also include (e.g., stored on one or more machine-readable media) instructions (e.g., software) 520 embodying any one or more of the aspects and/or methodologies of the present disclosure. In another example, memory 508 may further include any number of program modules including, but not limited to, an operating system, one or more application programs, other program modules, program data, and any combinations thereof.

Computer system 500 may also include a storage device 524. Examples of a storage device (e.g., storage device 524) include, but are not limited to, a hard disk drive, a magnetic disk drive, an optical disc drive in combination with an optical medium, a solid-state memory device, and any combinations thereof. Storage device 524 may be connected to bus 512 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, storage device 524 (or one or more components thereof) may be removably interfaced with computer system 500 (e.g., via an external port connector (not shown)). Particularly, storage device 524 and an associated machine-readable medium 528 may provide nonvolatile and/or volatile storage of machine-readable instructions, data structures, program modules, and/or other data for computer system 500. In one example, software 520 may reside, completely or partially, within machine-readable medium 528. In another example, software 520 may reside, completely or partially, within processor 504.

Computer system 500 may also include an input device 532. In one example, a user of computer system 500 may enter commands and/or other information into computer system 500 via input device 532. Examples of an input device 532 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 532 may be interfaced to bus 512 via any of a variety of interfaces (not shown) including, but not limited to, a serial interface, a parallel interface, a game port, a USB interface, a FIREWIRE interface, a direct interface to bus 512, and any combinations thereof. Input device 532 may include a touch screen interface that may be a part of or separate from display 536, discussed further below. Input device 532 may be utilized as a user selection device for selecting one or more graphical representations in a graphical interface as described above.

A user may also input commands and/or other information to computer system 500 via storage device 524 (e.g., a removable disk drive, a flash drive, etc.) and/or network interface device 540. A network interface device, such as network interface device 540, may be utilized for connecting computer system 500 to one or more of a variety of networks, such as network 544, and one or more remote devices 548 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 544, may employ a wired and/or a wireless mode of communication. In general, any network topology may be used. Information (e.g., data, software 520, etc.) may be communicated to and/or from computer system 500 via network interface device 540.

Computer system 500 may further include a video display adapter 552 for communicating a displayable image to a display device, such as display device 536. Examples of a display device include, but are not limited to, a liquid crystal display (LCD), a cathode ray tube (CRT), a plasma display, a light emitting diode (LED) display, and any combinations thereof. Display adapter 552 and display device 536 may be utilized in combination with processor 504 to provide graphical representations of aspects of the present disclosure. In addition to a display device, computer system 500 may include one or more other peripheral output devices including, but not limited to, an audio speaker, a printer, and any combinations thereof. Such peripheral output devices may be connected to bus 512 via a peripheral interface 556. Examples of a peripheral interface include, but are not limited to, a serial port, a USB connection, a FIREWIRE connection, a parallel connection, and any combinations thereof.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. An electric watercraft having a warning light, the electric watercraft comprising:

at least an electric propulsor configured to propel the electric watercraft in a fluid;

a plurality of battery packs located beneath a deck of the electric watercraft and configured to power the at least an electric propulsor;

at least a warning light located on an aft facing surface of the electric watercraft and configured to be viewable from behind the electric watercraft; and at least a sensor configured to:

detect at least a speed of the electric watercraft;

detect a current steering angle of the electric watercraft;

calculate a steering angle threshold as a function of the at least a speed of the electric watercraft; and generate at least a warning signal as a function of the at least a speed, the current steering angle, and the steering angle threshold; and at least a controller located on the electric watercraft and in communication with the at least a warning light, wherein the controller is configured to:

receive the at least a warning signal; and illuminate the at least a warning light as a function of the at least a warning signal.

2. The electric watercraft of claim 1, wherein the electric watercraft comprises an electrically powered jet-propelled personal watercraft.

3. The electric watercraft of claim 1, wherein the at least a controller is further configured to:

receive a user input from the user; and generate the at least a warning signal as a function of the user input.

4. The electric watercraft of claim 1, wherein the at least a sensor is further configured to:

detect at least a throttle datum of the electric watercraft; and generate the at least a warning signal as a function of the at least a throttle datum.

5. The electric watercraft of claim 1, wherein the at least a sensor is further configured:

detect a first pressure on a first axis;

detect a second pressure on a second axis; and generate the at least a warning signal as a function of the first pressure and the second pressure.

6. The electric watercraft of claim 1, wherein the electric watercraft further comprising:

at least a safety device, wherein the at least a safety device is configured to:

receive at least an activation signal; and generate the at least a warning signal as a function of the at least an activation signal.

7. The electric watercraft of claim 1, wherein illuminating the at least a warning light further comprises a plurality of lighting patterns.

8. The electric watercraft of claim 1, wherein illuminating the at least a warning light further comprises a plurality of colors.

9. A method for using an electric watercraft having a warning light, wherein the method comprises:

propelling, using at least an electric propulsor, the electric watercraft in a fluid;

powering, using a plurality of battery packs located beneath a deck of the electric watercraft, the at least an electric propulsor;

sensing, using at least a sensor configured to:

detect at least a speed of the electric watercraft;

detect a current steering angle of the electric watercraft;

calculate a steering angle threshold as a function of the at least a speed of the electric watercraft; and generate at least a warning signal as a function of the at least a speed, the current steering angle, and the steering angle threshold;

receiving, using at least a controller, the at least a warning signal, wherein the at least a controller is located on the electric watercraft and in communication with at least a warning light; and illuminating, using the at least a controller, the at least a warning light as a function of the at least a warning signal, wherein the at least a warning light is located on at an aft facing surface of the electric watercraft and configured to be viewable from behind the electric watercraft.

10. The method of claim 9, wherein the electric watercraft comprises an electrically powered jet-propelled personal watercraft.

11. The method of claim 9, further comprising:

receiving, using the at least a controller, a user input from the user; and generating, using the at least a controller, the at least a warning signal as a function of the user input.

12. The method of claim 9, further comprising:

detecting, using the at least a sensor, at least a throttle datum of the electric watercraft; and generating, using the at least a sensor, the at least a warning signal as a function of the at least a throttle datum.

13. The method of claim 9, further comprising:

detecting, using the at least a sensor, a first pressure on a first axis;

detecting, using the at least a sensor, a second pressure on a second axis; and generating, using the at least a sensor, the at least a warning signal as a function of the first pressure and the second pressure.

14. The method of claim 9, further comprising:

receiving, using at least a safety device, at least an activation signal; and generating, using the at least a safety device, the at least a warning signal as a function of the at least an activation signal.

15. The method of claim 9, wherein illuminating the at least a warning light further comprises a plurality of lighting patterns.

16. The method of claim 9, wherein illuminating the at least a warning light further comprises a plurality of colors.

* * * * *